US009017133B2

(12) United States Patent
Rolf

(10) Patent No.: US 9,017,133 B2
(45) Date of Patent: Apr. 28, 2015

(54) TOY BUILDING BLOCK

(75) Inventor: Theodorus Suibertus Anthonius Rolf, Leukerbad (CH)

(73) Assignee: Kiditec AG (CH)

( * ) Notice: Subject to any disclaimer, the term of this patent is extended or adjusted under 35 U.S.C. 154(b) by 2430 days.

(21) Appl. No.: 10/552,027

(22) PCT Filed: Apr. 1, 2004

(86) PCT No.: PCT/CH2004/000198

§ 371 (c)(1),
(2), (4) Date: Oct. 3, 2005

(87) PCT Pub. No.: WO2004/087277

PCT Pub. Date: Oct. 14, 2004

(65) Prior Publication Data

US 2006/0194505 A1 Aug. 31, 2006

(30) Foreign Application Priority Data

Apr. 4, 2003 (EP) ..... 03405229

(51) Int. Cl.
*A63H 33/04* (2006.01)
*A63H 33/08* (2006.01)

(52) U.S. Cl.
CPC ..... *A63H 33/086* (2013.01)

(58) Field of Classification Search
USPC ..... 446/117–126, 128
See application file for complete search history.

(56) References Cited

U.S. PATENT DOCUMENTS 2,609,638 A * 9/1952 Lindenmeyer ..... 446/126
3,233,358 A * 2/1966 Dehm ..... 446/102
3,487,579 A * 1/1970 Brettingen ..... 446/128
4,582,495 A * 4/1986 Orgass et al. ..... 446/102
5,447,584 A 9/1995 Shakespeare et al.
5,471,808 A * 12/1995 De Pieri et al. ..... 52/603
5,498,188 A * 3/1996 Deahr ..... 446/75
D384,994 S * 10/1997 Nielsen ..... D21/486

(Continued)

FOREIGN PATENT DOCUMENTS

AT 184 497 1/1956
DE 3503211 A1 * 8/1986

(Continued)

OTHER PUBLICATIONS

International Search Report for PCT/CH2004/000198 dated Oct. 25, 2004.

(Continued)

*Primary Examiner* — Melba Bumgarner
*Assistant Examiner* — Amir Klayman
(74) *Attorney, Agent, or Firm* — Ostrolenk Faber LLP

(57) ABSTRACT

A toy building block (1) for stacking is provided on top (4) with one or more studs (3) and in the bottom (7) with recesses (6). The studs (4) show a toothwheel-like cross-section with rounded teeth crests (12) and rounded grooves (10) between the teeth (12) as well. The recesses (6) are provided each with a number of vertically extending lands (14) matching in shape the grooves (10). The studs easily slide in and out of the recesses (6), yet a rotational arretation of low play is obtained. Preferably, the building blocks are produced by a blowing process and may be provided with screws (21) for a safe interconnection. External slots (46) may allow the combination with panels (47) bearing images, additional functional elements etc.

19 Claims, 5 Drawing Sheets

(56) References Cited

U.S. PATENT DOCUMENTS

Figures 1, 2:
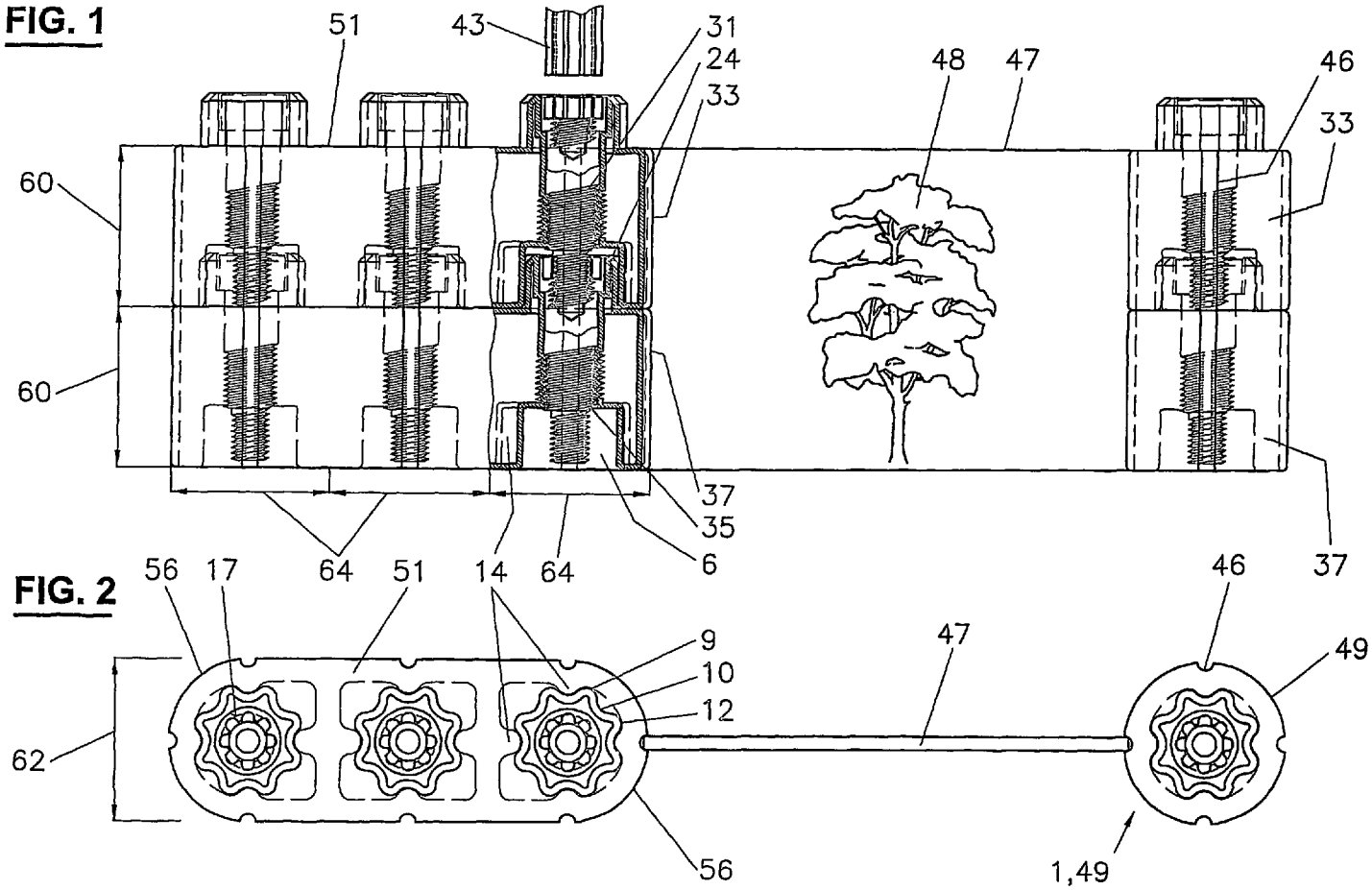

| | | | | | |
|---|---|---|---|---|---|
| 5,725,411 | A | * | 3/1998 | Glynn | 446/128 |
| 5,795,210 | A | * | 8/1998 | Kushner et al. | 446/128 |
| 5,938,497 | A | * | 8/1999 | Mott | 446/122 |
| 6,088,987 | A | * | 7/2000 | Simmons et al. | 52/592.6 |
| 6,129,605 | A | * | 10/2000 | Cyrus et al. | 446/118 |
| 6,506,091 | B1 | | 1/2003 | Garpow | |
| D564,044 | S | * | 3/2008 | Rolf | D21/486 |
| 2003/0029119 | A1 | | 2/2003 | Coleman | |

FOREIGN PATENT DOCUMENTS

| | | | |
|---|---|---|---|
| DE | 42 12 492 | A1 | 10/1992 |
| EP | 0 189 514 | | 6/1985 |
| EP | 1 610 876 | | 10/2009 |
| GB | 2 136 700 | A | 9/1984 |
| JP | 37-30754 | | 11/1937 |
| JP | 45-27882 | | 10/1970 |
| JP | 56-168775 | | 12/1981 |
| JP | 59-42075 | | 12/1984 |
| JP | 60-85778 | | 5/1985 |
| JP | 9-504711 | | 5/1997 |
| JP | 3085655 | | 5/2002 |
| WO | WO 86/04516 | | 8/1986 |
| WO | 90/09825 | | 9/1990 |
| WO | 93/08887 | | 5/1993 |
| WO | 97/32643 | | 9/1997 |

OTHER PUBLICATIONS

English translation of Japanese Office Action issued May 21, 2010 in connection with corresponding Japanese Patent Application No. 350539.

English translation of Japanese Office Action issued May 15, 2009 in connection with corresponding Japanese Patent Application No. 303354.

Comments regarding prior art.

English translation of the Appeal Board's Questioning mailed Jun. 17, 2011 in corresponding Japanese Application No. 2010-025578, Appeal No. 2011-004427.

* cited by examiner

FIG. 3
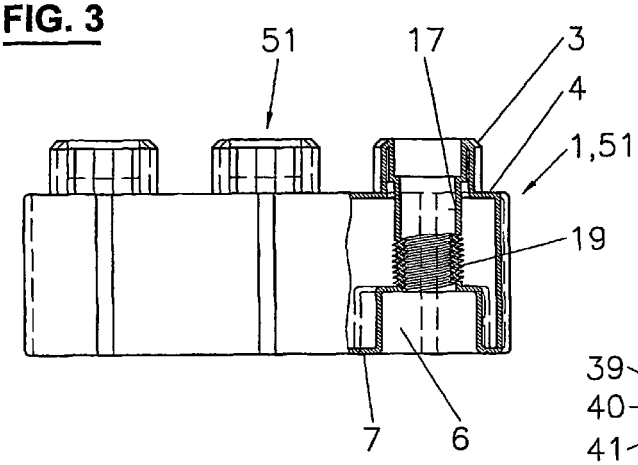
FIG. 6a
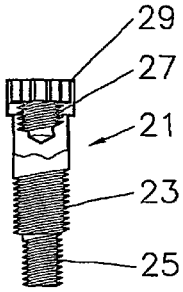
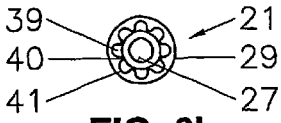
FIG. 6b
FIG. 4
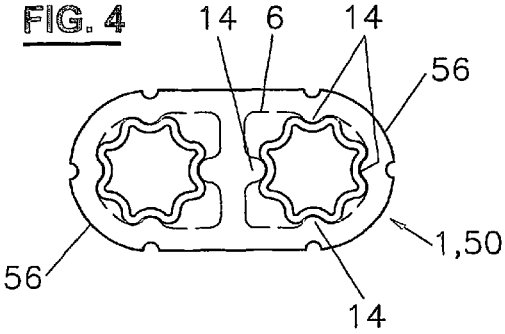
FIG. 7a
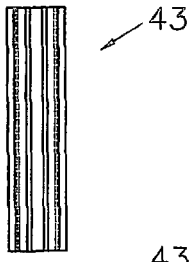
FIG. 5
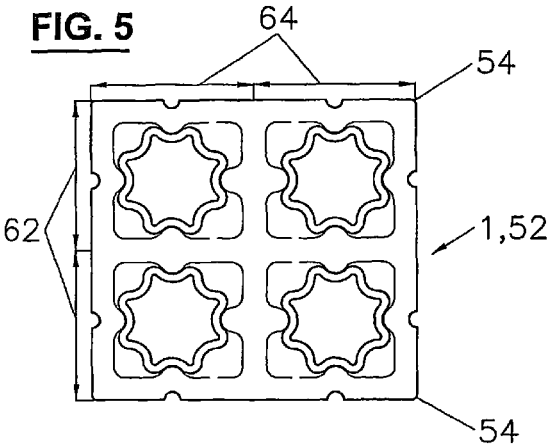
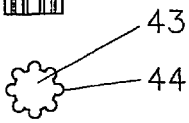
FIG. 7b FIG. 16
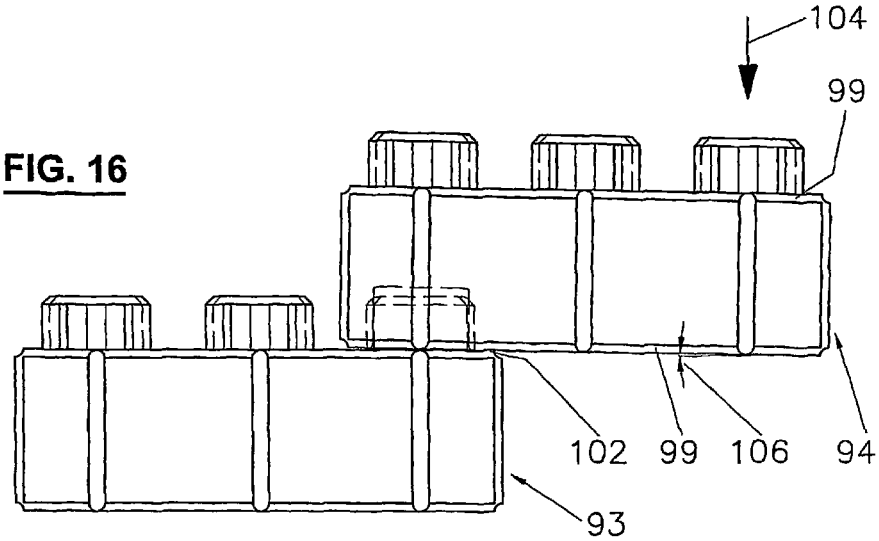
FIG. 17
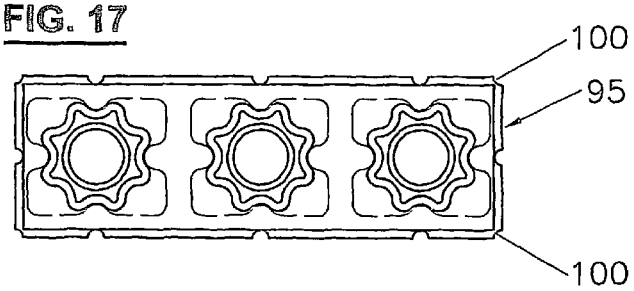
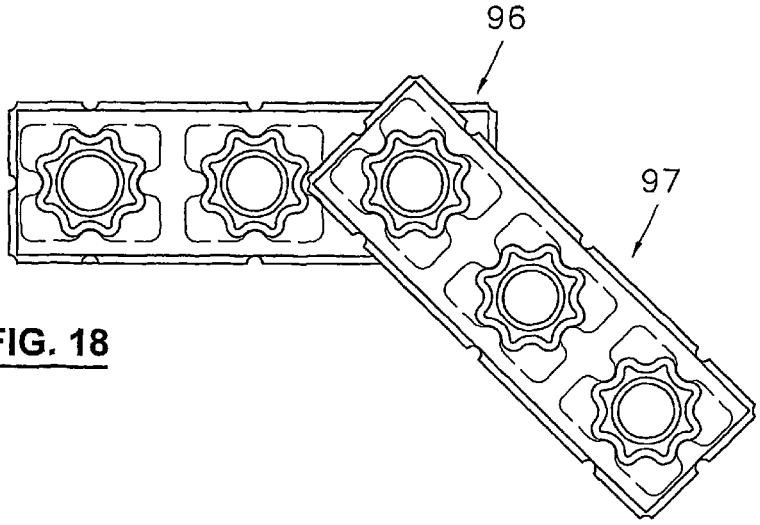
FIG. 18

TOY BUILDING BLOCK

CROSS-REFERENCE TO RELATED APPLICATIONS

This is a 35 U.S.C. §371 National Stage of International Application No. PCT/CH2004/000198, filed on Apr. 1, 2004. Priority is claimed on that application and on the following application:

Country: Europe, Application No. 03405229.0, Filed: Apr. 4, 2003.

The present invention relates to a toy building block. It also relates to a screw suited to be used in the toy building block, and a screwdriver tool.

Toy building blocks for stacking one on top of the other are generally provided with studs on their top surface and with corresponding recesses on their bottom surfaces. The studs can be pushed into the recesses with more or less force, whereby the engaged force is related to the strength of the thereby established interconnection of two building blocks. After some cycles of attaching and separating, the force generally fades, and the connection strength diminishes in parallel with an increase of rotational play. Particularly, the significant forces for assembling new building blocks render them less suited for smaller children.

Another criterion is the capability and ease of 3-dimensional construction in connection with only a few types of building blocks. Most of the known building block systems provide a quite significant number of specially shaped building blocks in order to deal with different situations.

Hence, it is one object of the present invention to propose a toy building block, which may be attached to another block with only reduced force, yet provides good interconnection strength, particularly in view of rotational play.

It is a further object to provide means for fastening these building blocks to another.

The first mentioned object is attained by the toy building block described herein. Preferred embodiments thereof, fastening means, which resolve the second object, and a tool for operating the fastening means are also disclosed.

Accordingly, the building block according to the invention is provided on its surface with at least one stud. The stud of generally cylindrical shape has a cross-section which resembles a tooth wheel, with the teeth and grooves between the teeth being rounded. Preferably, the cross-section consists of a sequence of circle sections, or more generally curved sections, consecutively arranged with alternating convex-concave characteristics. Preferably, the grooves are made of arcs of larger diameter, i.e. smaller curvature than the teeth.

Complementary to the studs, in the bottom surface of the toy building blocks, recesses are provided with at least one vertically extending land. If a stud is inserted in a recess, the lands slide in the grooves of the studs. This movement requires a relatively small force. In contrast, due to the peculiar cross-section, there is about no sensible play with respect to rotation, even after a number of assembly/disassembly cycles.

The invention will be explained in detail by means of a preferred embodiment with reference to the figure:

FIG. 1 Front view of an arrangement made of the toy building blocks according to the invention with an integrated panel, with partial sectional view;

FIG. 2 Top view on the arrangement of FIG. 1;

FIG. 3 Side view of a 3-stud building block, with partial cut;

FIG. 4 Top view on a 2-stud building block;

FIG. 5 Top view of a 2×2-stud building block;

FIG. 6*a* Elevational view with partial section of a screw;

FIG. 6*b* Top view of the screw of FIG. 6*a;*

FIG. 7*a* Elevational view of a screwdriver;

FIG. 7*b* Top view of the screwdriver of FIG. 7*a;*

Figure 8:
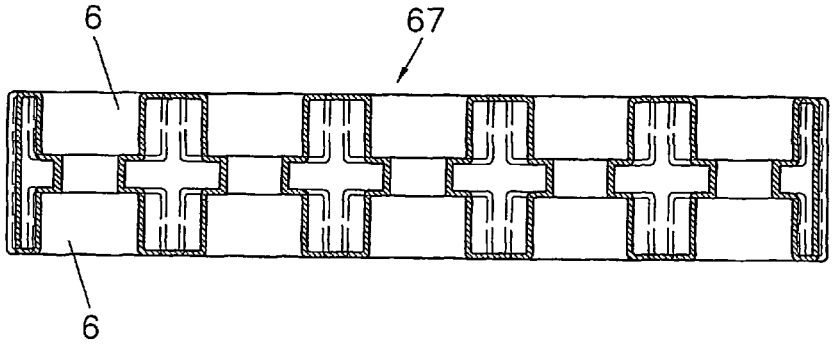
Figure 9:
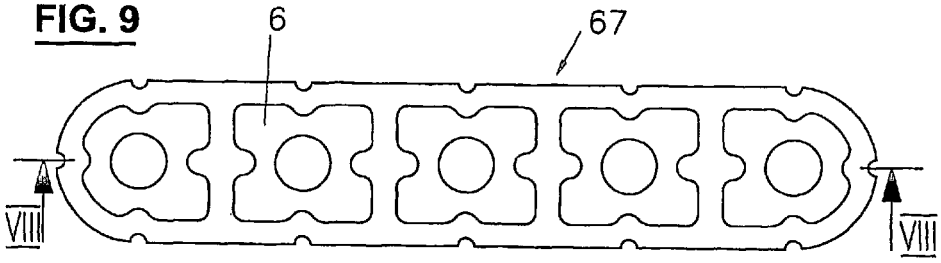
Figure 10A:
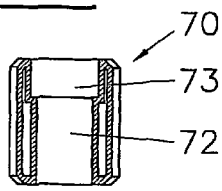
Figure 10B:
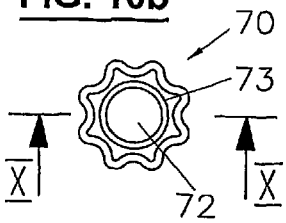

FIG. 8 Longitudinal section of a bivalent building block;

FIG. 9 Top view of the building block of FIG. 8;

FIG. 10 Section (a) and top (b) view of removable post; Section according to X-X in FIG. 10*b;*

Figure 11:
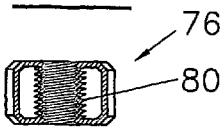
Figure 12:
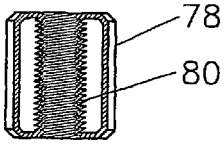
Figure 13:
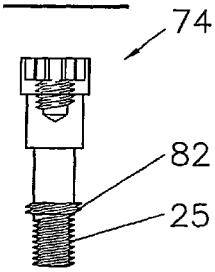
Figure 14:
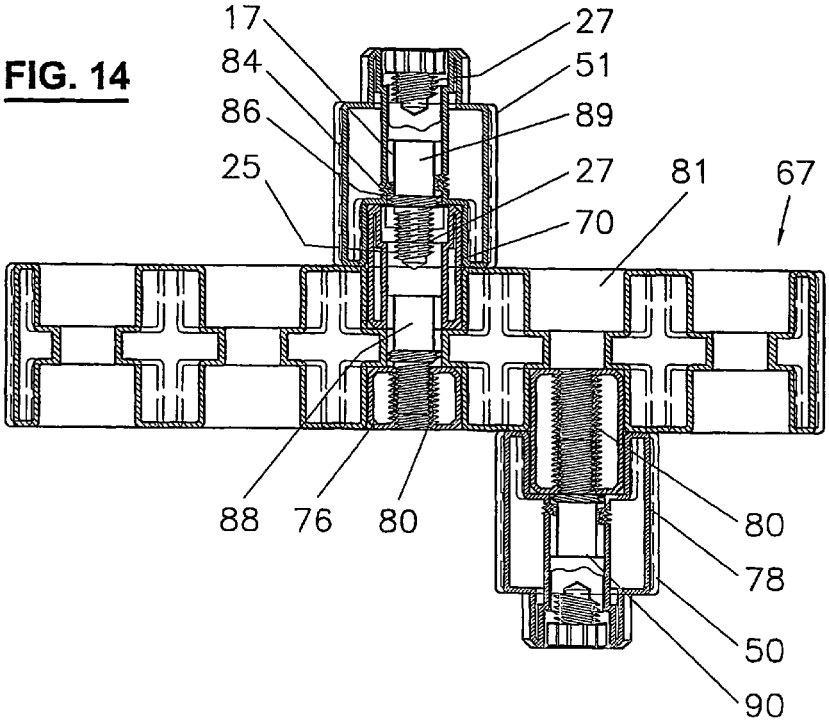
Figure 15:
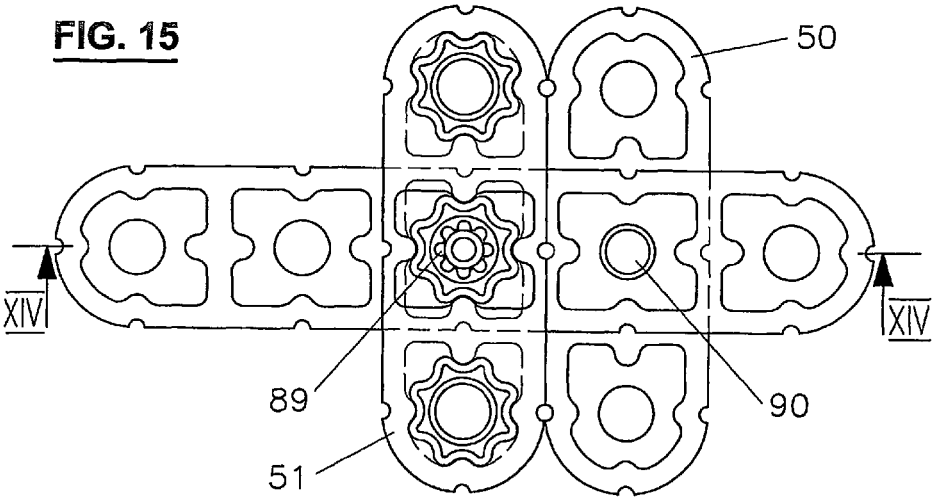

FIG. 11 Longitudinal section of a short nut;

FIG. 12 Longitudinal section of a long nut;

FIG. 13 Side view of 2nd type of a bolt;

FIG. 14 Longitudinal section of a mounting arrangement with a bivalent building block according to XIV-XIV in FIG. 15;

FIG. 15 Top view on the arrangement of FIG. 14;

FIG. 16 Side view on stack of construction blocks having horizontal semi-grooves;

FIG. 17 Top view on a construction block of FIG. 16; and

FIG. 18 Top view on an angled arrangement of construction blocks.

The toy building block 1 is provided with studs 3 on its upper surface 4 and one or more recesses 6 in its lower surface 7 (FIG. 3). The studs 3 are of a toothwheel-like cross-section, with the teeth 9 and the interstices or grooves 10 inbetween showing a rounded shape. Particularly, they constitute a circular arrangement essentially of circle sections, with alternating curvature direction. In the example, the absolute value of the curvature of the tooth crests 12 is significantly higher than the curvature of the grooves 10. The cross-section of the studs is of 8-fold symmetry, i.e. the teeth are arranged according to a regular octagone.

Due to this rotational symmetry, the studs 3 and consequently the building blocks 1 can be attached to another block 1 in fixed rotational orientation in steps of 45°, namely linearly, transversely (90°) and by angles of 45°. Thereby, a manifold of three-dimensional arrangements can be created.

Complementarily, the recesses 6 in the bottom of the building blocks 1 are provided with vertically extending lands 14. The cross-section of the lands 14 is chosen the way that they easily slide in the grooves 10 of a stud 3 inserted in the recess, yet provides a snug rotational fixation.

In the example, there is one recess provided per stud and each recess is provided with four lands 14.

For a safe interconnection, a variant of the building block (cf. FIGS. 1, 3) is provided with a hole 17 provided with a first thread 19 in each stud 3. In the hole 17, a screw 21 can be inserted. The screw 21 has a second thread 23 in its thicker middle part, a third thread 25 at its end and a fourth thread 27 inwardly in its head 29. The third thread 25 is matched with the fourth thread 27 so that a screw 31 in an upper building block 33 can be screwed into the head 29 of the screw 35 in the building block 37 beneath (FIG. 1).

With the screws removed, the building blocks prepared for screws can be used together with the first type of building blocks not provided with holes 17. As well, building blocks of the first type may be stacked on building blocks of the 2nd type, regardless whether screws are present or not. For a transition from a 1st building block to a 2nd type building block, the latter may e.g. be provided with screws where the end bearing the 3rd thread is omitted.

The head 29 of the screw 21 is of cylindrical shape and provided with a central circular recess 39. The side wall of the recess 39 is again shaped toothwheel-like, yet this time, the teeth 40 inwardly directed are not rounded, though the grooves 41 outwardly directed are (FIG. 6*b*). Hence, a complementary shaped screwdriver tool 43 can be used to operate the screws 21 by inserting it in the head recess 39. The screwdriver 43 is simply a bar provided with the cross-section showing the required, complementary shape 44. On one hand, this tool is simple in use, hence suited to children of low age, and the uneven surface guarantees a good grip. Furthermore, the screwdriver will not roll away due to its uneven surface, and when inserted in a screw head, it stands in the head by itself.

Reverting to the building blocks 1, the lateral outer faces are provided with slots 46, in which panels 47 can be inserted (cf. FIG. 1). Thereby, arrangements with the building blocks can be combined with panels showing ornaments 48, colours, representations of cartoon figures, additional functional elements (wheels, instruments for generating sounds or tones) and the like.

The slots 46 are arranged in parallel to the central axis of the studs 3 so that the panels 47 constitute a regular extension of the building blocks 1. In the example, the slots 46 are arranged in 90° position, yet additional slots may be provided, e.g. in 45° position.

Generally, the building blocks 1 may provide one (FIG. 1; 49) or more studs 3, equivalent to constructional units. E.g. FIG. 4 shows a building block 50 with 2 studs or 2 constructional units, FIGS. 1, 2 and 3 one 51 with 3 construction units in linear arrangement, and FIG. 5 one 52 with 4 construction units in a quadratic arrangement. As it is shown as well, the corners of the building blocks may be edged, however slightly rounded for safety reasons (cf. FIG. 5, edges 54), or the ends of the building block may be shaped like a cylinder (cf. FIG. 1, shape of single-stud block 49, and FIGS. 2 and 3, end sections of 2-stud and 3-stud blocks 50 and 51).

FIGS. 8 and 9 show a bivalent construction block 67: This block is provided on the upper and lower side with recesses 6, in this case five each time. Impair numbers are preferred because of a recess (or a stud) located in the middle of the block. In the recesses of the bivalent construction block 67, studs 3 of other construction blocks may be inserted. Thereby, it is possible to build stacks of construction blocks of opposite orientation.

It is also possible to provide the recesses 6 of the bivalent construction block 67 with studs. FIG. 10 shows a stud insert 70. Internally, a base 72 is provided with an enlargement 73 on one end corresponding to the screw 21 (or the 2nd screw 74, see below).

The insert 70 can be a mounted and fixed in a recess 6 by means of a screw 21, 74 and a short nut 76 or a long nut 78. The difference is illustrated in FIG. 14: The short nut 76 fits in a recess 6 so that it does not protrude. In contrast, a long nut 78 protrudes from the recess 6 and, so, constitutes another stud 6 extending in the opposite direction.

Of course, both types of nuts show essentially the same outer shape as the insert 70, i.e. that of a stud as shown in FIG. 10*b*. Though the insert 70 and the long nut 78 may not be provided with this shape on one end, and it is not essential for the short nut 76, thereby, the nuts 76, 78 and the insert 70 are held in the recesses and secured against rotation, hence fastening the screws 21, 74 is facilitated.

The internal thread 80 of the nuts 76, 78 matches with the 3rd thread 25 of the screws 21, 74. The insert 70, on the other hand, is not provided with a thread, so that a screw 21, 74 may push through without screwing.

Regarding the screw 74, in contrast to screw 21, it is provided with a significantly shortened 2nd thread 82. This is to be seen in combination with the 1st thread 19 internal of the studs 3 being shortened.

Basically, the thread 19 is to be provided at a small distance from the lower end of hole 17 so that a screw 74 may be screwed through the shortened thread 19, until the thread 82 is below thread 19, hence the screw being freely rotatable (captive screw).

As it is shown in FIG. 14, the hole 17 may be provided with a 1st thread 84 shortened to about one turn, yet at a location of at least about the height of thread 82 upwards of the lower end of hole 17. Thereby, below the thread 84, a space 86 is created where the thread 82 can freely move.

FIGS. 14 and 15 show a 3-stud block 51 mounted on the upper side of a bivalent block 67. A detachable stud insert 70 is fixed in a recess 6 using a screw 88 and a short nut 76. On the insert 70, the 3-stud block 51 is placed orthogonally to the bivalent block 67 and fixed by another screw 89.

On the bottom face of the bivalent block 67, a 2-stud block 50 is mounted in the opposite orientation of 3-stud block 51, i.e. upside down. For this purpose, a long nut 76 is fixed in a recess 6 of the 2-stud block 51 by means of a screw 90. This arrangement may be further fixed by inserting another stud insert 70 in the recess 81, driving a screw 21, 74 through it, and screwing it in the thread 80 of the long nut 76. Of course, a shortened version of the screws 21, 74 may serve the purpose without an insert 70. However, by introducing screws of a second length, the building system get more complicated.

FIGS. 16-18 show that the building blocks 93-97 are provided with additional half-grooves 99, 100 at the upper and lower horizontal edges respectively along the lateral edges. By assembling two blocks, e.g. blocks 93, 94, the half-grooves build together a groove 102, wherein a panel 47 may be held.

FIG. 16 demonstrates an important feature of the construction blocks. Due to the significant height of the studs 3, i.e. the significant engagement in the recesses 6, and the positive engagement of the lands 14 of the recesses 6 in the corresponding grooves 10 of the studs 3, the arrangement of FIG. 16 only shows a small tilting of the upper construction block 94 even without the blocks together, and in spite of that the two terminal studs of the two blocks are used. Additionally, even a force 104 does not significantly increase the tilting angle 106 due to the positive engagement. Still to be mentioned that this advantage is obtained with retaining the feature of easy and smooth assembly behaviour, in contrast to systems where construction blocks have to be forced together because of the interconnection being stabilized by squeezing.

Another property of the construction system according to the invention is that it is almost not subject to wear.

Finally, regarding FIG. 18, an angled arrangement is shown. Obviously, with the exemplary 8-fold rotational symmetry of the stud, 45° degree angles and multiple thereof are realizable. Just in this angled arrangement, the rigidity of the vertical inter connection is an advantage and allows bridge-constructions even without bolting.

Another advantageous aspect of the illustrated building blocks consists in that they are based on a cubic unity, i.e. a volume unit with cell height 60, cell width 62 and cell length 64 all being identical. Thereby, building 3-dimensional constructions is simplified, and the number of required types of building blocks is reduced to a few only.

As variants thereof, building blocks may be considered, where one or the other of the dimensions (length, width and/or height) are an integer multiple or fraction of the basic unit.

The building blocks are manufactured by blow molding. As the so obtained building blocks are hollow, they are light and even float. By this production manner, e.g. building blocks based on 60 mm length unit can be manufactured, which are tough and are suited for little children due to their size, yet are light. In view of the blowing, it is an advantage that sharp edges can be totally eliminated from the shape of the building blocks.

Still to mention, as an example, that it is possible to use the blown building blocks as a package, for fluid materials like beverages or liquid soap, and instead of being thrown away, it later serves as a toy.

The building blocks may also be manufactured by another process, e.g. injection molding. However, blowing permits more freedom in shaping the surface in comparison with injection molding.

In practice, another advantageous property has been observed: the building blocks manufactured by blowing slide very easily into another, yet the faces of the studs show an adhesion effect to the zones of contact within the recesses of the construction stacked upon. This effect improves the final construction in view of stability and rigidity without impairing ease of disassembly. From an esthetical point of view, it is observed that the shape of the studs reminds of flowers which gives an attractive impression, especially for smaller children, and serves as an ornamental element.

As well, the screws may be manufactured by any suited process. For instance, they may be blow-molded. The thereby obtained screws are hollow and light-weight. Another nearby manufacturing process is injection molding.

From the description of the preferred execution example, the one skilled in the art may easily derive variants without leaving the scope of the invention which is defined by the claims.

Some variants one may think of are:

The building blocks may bear any other number of studs and/or recesses, e.g. 6, 8, in various arrangements.

The symmetry of the studs may be varied, e.g. an 12fold symmetry corresponding to rotational steps of 30° may be chosen. Even symmetries of an odd order may be considered, though they render an even simple construction rather difficult, if not impossible to realize for children.

The basic units may be varied in a wide range. Also, one or the other of the units may differ from the other basic units, e.g. the height unit may be one half of the width and length unit.

The building blocks may consist of a large variety of materials, which can be used in the chosen manufacturing process, preferably blowing. Preferred are, of course, light materials like polymers, possibly reinforced by fibrous materials, even of organic or biologic origin.

The basic shape may vary, e.g. to comply with a prior use as a bottle, or a container.

The bottom recesses are shaped otherwise, e.g. with three sidewalls each bearing a land, or at least one bearing a land for rotational fixation more sidewalls may be present providing a polygonal cross-section.

The top surface may be inclined with respect to the bottom plane for building angled stacks.

As fastening means, bayonet connectors are used.

The height of the studs 3, and/or the depth of the recesses 6 may vary. Of course, the recesses 6 should be able to receive a stud in full. Preferably, the height of the studs is at least 30% of the cell height 60, most preferably about a third. The same applies to the depth of the recesses, maybe with a certain overmeasure to compensate for production tolerances.

The invention claimed is:

1. A toy building block capable of being stacked, comprising:

a top surface of the block having thereon at least one stud with a plurality of circumferentially arranged, substantially equally spaced teeth with rounded crests and interspersed rounded grooves, the stud having a height extending above the top surface of the block by at least about 30% of the height of the block; and a bottom surface of the block having at least one recess with sidewalls, at least one sidewall of the recess having a substantially vertically extending land shaped complementary to and extending into a respective one of the rounded grooves of the stud, wherein the stud is configured and operable to be insertable in the recesses of other like toy building blocks, and the stud on one block is guided into a recess of another of the blocks by the lands in the recess of the other block wherein the recesses are shaped such that one of the studs inserted in one of the recesses is guided by at least three zones of contact, and at least one of the zones is a land in the recess of another of the blocks engageable in one of the rounded grooves in the stud.

2. A toy building block according to claim 1, wherein the recess further comprises at least three of the vertically extending lands each shaped complementary to the rounded grooves of the stud.

3. A toy building block according to claim 2, wherein the lands constitute the majority of contact zones for guiding a stud inserted into the recess.

4. A toy building block according to claim 1, wherein the studs have a rotational symmetry of at least 4-fold.

5. A toy building block according to claim 1, wherein the rotational symmetry of the studs is 6-fold, 8-fold or 12-fold.

6. A toy building block according to claim 1, wherein the block consists of essentially cuboid units, and each of the cuboid units is provided with one of the studs and one of the recesses.

7. A toy building block according to claim 1, further comprising a pass-through hole provided centrally in at least one stud or one recess, the pass-through hole extending from top to bottom of the building block.

8. A toy building block according to claim 7, wherein the pass-through hole is provided in at least one stud, and is further provided with an enlargement within the stud configured and operative for receiving a head of a screw.

9. A toy building block according to claim 1, wherein the block comprises a hollow portion and is manufactured by blowing of a material comprising polymeric mass as an essential constituent.

10. A toy building block according to claim 1, wherein the block has a lateral outer face and is provided with at least one slot penetrating the lateral outer face from one side of the lateral outer face to an opposite side, configured and operative for holding edges of construction devices.

11. A toy building block according to claim 1, wherein the block comprises a bivalent building block having at least one of the recesses on the top surface and the bottom surface, and the at least one stud comprises a piece having the plurality of circumferentially arranged, substantially equally spaced teeth with rounded crests and interspersed rounded grooves of the stud and about double a length of the recess, and the piece is configured to be inserted in the at least one recess of the bivalent building block.

12. A toy building block set comprising:

at least one toy building block according to claim 7; and at least one screw having a head, a first thread on a body terminal section of the screw, and a second inner thread in the head of the screw, the second thread being matched with the first thread so that the screw may be screwed in the head of another like screw.

13. A toy building block set comprising:

at least one toy building block according to claim 7; and at least one screw configured and operative to be positioned into the pass-through hole of the toy building block, and a recess in the head of the screw, the recess having a cross-section comprised of regularly arranged, inwardly directed crests separated by generally circle shaped grooves, configured and operative for a complementarily shaped end of a tool to be inserted and rotationally fixed in the head.

14. A toy building block set according to claim 13, wherein the cross-section of the recess in the head has at least four of the crests.

15. A toy building block set according to claim 12, further comprising a screwdriver tool for the screw, the screwdriver tool having a rod with its cross-section being substantially complementarily-shaped to the recess in the screw.

16. A toy building block according to claim 7, wherein the pass-through hole is provided with a third thread configured and operative for a screw to be screwed through the toy building block.

17. A toy building block according to claim 16, wherein the at least one pass-through hole is provided in at least one stud, and is further provided with an enlargement within the studs configured and operative to receive a head of a screw.

18. A toy building block set according to claim 12, wherein the screw has a body with a middle part which is provided with a fourth thread that is matched with a third thread provided in the pass through hole, and the first thread has a smaller diameter than the fourth thread.

19. A toy building block set according to claim 18, wherein the screw head is provided with a recess, the recess having a cross-section comprised of regularly arranged, inwardly directed crests separated by generally circle shaped grooves, configured and operative for a complementarily shaped end of a tool to be inserted and rotationally fixed in the head.

* * * * *